US007726050B2

(12) United States Patent
Itou

(10) Patent No.: US 7,726,050 B2
(45) Date of Patent: Jun. 1, 2010

(54) HYDRAULIC SHOVEL

(75) Inventor: Shinichi Itou, Kawagoe (JP)

(73) Assignees: Komatsu Ltd., Tokyo (JP); Komatsu Utility Co., Ltd., Tokyo (JP)

( * ) Notice: Subject to any disclaimer, the term of this patent is extended or adjusted under 35 U.S.C. 154(b) by 268 days.

(21) Appl. No.: 11/815,700

(22) PCT Filed: Feb. 7, 2006

(86) PCT No.: PCT/JP2006/302079

§ 371 (c)(1),
(2), (4) Date: Aug. 7, 2007

(87) PCT Pub. No.: WO2006/085532

PCT Pub. Date: Aug. 17, 2006

(65) Prior Publication Data

US 2009/0007464 A1 Jan. 8, 2009

(30) Foreign Application Priority Data

Feb. 8, 2005 (JP) ..... 2005-031954

(51) Int. Cl.
*E02F 5/02* (2006.01)

(52) U.S. Cl. ..... 37/348; 60/431

(58) Field of Classification Search ..... 37/466, 37/348, 468; 172/2–12; 60/431, 433, 434; 91/449, 450, 451
See application file for complete search history.

(56) References Cited

U.S. PATENT DOCUMENTS 7,441,407 B2 * 10/2008 Sawada ..... 60/431

FOREIGN PATENT DOCUMENTS

| | | | |
|---|---|---|---|
| JP | 62-002801 | U | 1/1987 |
| JP | 62-002802 | U | 1/1987 |
| JP | 62-156603 | U | 10/1987 |
| JP | 08-100448 | A | 4/1996 |
| JP | 2000-039117 | A | 2/2002 |
| JP | 2003-278185 | A | 10/2003 |

OTHER PUBLICATIONS

Notification Concerning Transmittal of International Preliminary Report on Patentability, Chapter I of the Patent Cooperation Treaty, and Written Opinion of the International Searching Authority, dated Aug. 14, 2007, for PCT/JP2006/302079, 4 sheets.

* cited by examiner

*Primary Examiner*—Robert E Pezzuto
(74) *Attorney, Agent, or Firm*—Frishauf, Holtz, Goodman & Chick, P.C.

(57) ABSTRACT

A line 93 is provided with a line 71 communicating the line 93 and a hydraulic oil tank 51. The line 71 is provided with a throttle 72 to construct a throttle-provided line 7. When air is trapped between the hydraulic oil tank 51 and the hydraulic pump 52, the hydraulic pump 52 is driven to discharge the air from the throttle-provided line 7 to the hydraulic oil tank 51, thereby removing the air in the hydraulic circuit 5. When the air is removed, resistance caused by the throttle 72 is increased, which makes hydraulic oil flow from a pilot pump 522 to a PPC valve. Since the throttle-provided line 7 realizes air removal with a simple structure, a hydraulic cylinder 44 can be supplied with the air-removed hydraulic oil from an initial stage, thereby enhancing responsiveness of the hydraulic cylinder 44.

6 Claims, 7 Drawing Sheets

HYDRAULIC SHOVEL

This application is a U.S. National Phase Application under 35 USC 371 of International Application PCT/JP2006/302079 filed Feb. 7, 2006.

TECHNICAL FIELD

The present invention relates to a hydraulic excavator.

BACKGROUND ART

A hydraulic excavator includes a bucket cylinder, an arm cylinder and a boom cylinder respectively for operating a bucket, an arm and a boom, the cylinders driven by a hydraulic circuit (see, for instance. Patent Document 1). The hydraulic circuit includes a hydraulic oil tank for storing hydraulic oil, a hydraulic oil pump for supplying the cylinders with the hydraulic oil from the hydraulic oil tank, the cylinders hydraulically driven by the hydraulic oil from the hydraulic oil pump and a control valve for switching the supply of the hydraulic oil to the cylinders. The hydraulic oil in the hydraulic oil tank is supplied to the cylinders via the hydraulic oil pump and the control valve to operate the cylinders.

Some hydraulic excavators, especially small-size hydraulic excavators employ an arrangement where the hydraulic oil tank, which is generally disposed next to an operator cabin, is disposed below a floor to enlarge a cab for improving its comfortability (see, for example, Patent Document 2).

[Patent Document 1] JP-A-200)-39117 (FIG. 1)

[Patent Document 2] JP-A-2003-278185 (FIG. 2)

DISCLOSURE OF THE INVENTION

Problems to be Solved by the Invention

In the hydraulic excavator as in Patent Document 2, since the hydraulic oil tank is disposed below the floor, the hydraulic oil pump sometimes has to be located above the hydraulic oil tank. In such a case, for example, when the hydraulic oil in the hydraulic oil tank is replaced for maintenance or when the hydraulic oil in the hydraulic oil tank is reduced as a result of a long-term usage and a level of the hydraulic oil in the hydraulic oil tank falls below the level of the hydraulic oil pump, air may enter between the hydraulic oil pump and the hydraulic oil tank.

To remove the air, it is necessary to activate the hydraulic circuit to circulate the hydraulic oil in the hydraulic circuit, which takes considerable time. Further, since the air is contained in the hydraulic oil, hydraulic pressure necessary for operating an actuator cannot be obtained, so that the actuator cannot be operated. Accordingly, an initial responsiveness of the hydraulic excavator is impaired.

An object of the present invention is to provide a hydraulic excavator that can remove the air with a simple arrangement and provide enhanced activation capability of the actuator.

Means for Solving the Problems

A hydraulic excavator according to an aspect of the invention, includes: a hydraulic oil tank that stores hydraulic oil; a hydraulic pump that delivers the hydraulic oil from the hydraulic oil tank; an actuator that is driven by hydraulic pressure; and a closed-center control valve that is provided between the hydraulic pump and the actuator and switches a supply of the hydraulic oil. A throttle-provided line communicating a discharge-side line and the hydraulic oil tank is provided to the discharge-side line of the hydraulic pump.

According to the aspect of the invention, since the throttle-provided line communicating the discharge-side line of the hydraulic pump and the hydraulic oil tank is provided, when air enters between the hydraulic pump and the hydraulic oil pump, the air moves through the hydraulic pump by operating the hydraulic pump. At this time, since the throttle-provided line is in communication with the hydraulic oil tank, resistance in the flow passage of the throttle-provided line is smaller than that of the discharge-side line, so that the air is discharged to the hydraulic oil tank through the throttle-provided line. Subsequently, when the air is removed and the hydraulic oil is delivered into the throttle-provided line, since the pressure in the throttle-provided line is increased by the throttle, the hydraulic oil flows through the discharge-side line of the hydraulic pump. Accordingly, the actuator is supplied with the air-removed hydraulic oil.

Since the throttle-provided line is provided, the air between the hydraulic pump and the hydraulic oil tank can be speedily discharged and the actuator is supplied with the hydraulic oil including no air, thereby enhancing the activation capability of the actuator and the responsiveness of the hydraulic excavator. Since the throttle-provided line is provided with the throttle, the air-removed hydraulic oil automatically flows through the discharge-side line of the hydraulic pump on account of the increased resistance of the throttle, thereby eliminating the necessity of a switching means and achieving air removal with a simple structure.

Since the throttle-provided line allows rapid removal of the air between the hydraulic pump and the hydraulic oil tank, the hydraulic pump can be disposed above the hydraulic oil tank. Accordingly, components of the hydraulic circuit in the hydraulic excavator can be laid out with greater flexibility.

A hydraulic excavator according to another aspect of the invention, includes: a hydraulic oil tank that stores hydraulic oil; a hydraulic pump that delivers the hydraulic oil from the hydraulic oil tank; an actuator that is driven by hydraulic pressure; and a closed-center control valve that is provided between the hydraulic pump and the actuator and switches a supply of the hydraulic oil. A switching-valve-provided line that communicates a discharge-side line and the hydraulic oil tank and opens and closes a flow passage is provided to the discharge-side line of the hydraulic pump.

According to the aspect of the invention, the switching-valve-provided line communicating the discharge-side line of the hydraulic pump and the hydraulic oil tank is provided and the switching-valve-provided line switches opening and closing of the flow passage. Accordingly, when the air enters between the hydraulic pump and the hydraulic oil tank, only by delivering the oil by the hydraulic pump and switching the flow passage of the switching-valve-provided line to an open position, the trapped air is discharged into the hydraulic oil tank through the switching-valve-provided line of which resistance in the flow passage is smaller than that of the throttle-provided line. When the flow passage of the switching-valve-provided line is switched to a close position after the air is removed, the hydraulic oil flows through the discharge-side line of the hydraulic pump.

Since the switching-valve-provided line is provided, the air between the hydraulic pump and the hydraulic oil tank can be speedily discharged and the actuator is supplied with the air-removed hydraulic oil, thereby enhancing the activation capability of the actuator and the responsiveness of the hydraulic excavator. Since the flow passage of the switching-valve-provided line can be opened and closed, by opening the flow passage of the switching-valve-provided line to discharge the air and closing the flow passage after the air is removed, the hydraulic oil can easily circulate through the discharge-side line.

Since the flow passage of the switching-valve-provided line can be opened and closed and all of the air-removed hydraulic oil flows in the discharge-side line, sufficient flow rate and sufficient hydraulic pressure of the hydraulic oil can be easily obtained, so that the hydraulic oil can be effectively used.

Since the switching-valve-provided line allows rapid removal of the air between the hydraulic pump and the hydraulic oil tank, the hydraulic pump can be disposed above the hydraulic oil tank. Accordingly, components of the hydraulic circuit in the hydraulic excavator can be laid out with greater flexibility.

In the hydraulic excavator according to the aspect of the invention, the hydraulic pump may include a main pump that supplies the hydraulic oil to the actuator and a pilot pump that supplies the hydraulic oil for operating the control valve. The throttle-provided line or the switching-valve-provided line may be provided so as to communicate the discharge-side line of the pilot pump and the hydraulic oil tank.

According to the aspect of the invention, since the throttle-provided line or the switching-valve-provided line is provided so as to communicate the discharge-side line of the pilot pump and the hydraulic oil tank, the air in the hydraulic oil passes through the pilot pump with smaller flow passage resistance to be discharged through the discharge-side line of the pilot pump and the throttle-provided line or the switching-valve-provided line. Subsequently, the air-removed hydraulic oil flows in the discharge-side line of the pilot pump to generate hydraulic pressure for operating the control valve and is supplied from the main pump to the control valve. Hence, the main pump is supplied with the air-removed hydraulic oil from an initial stage, thereby ensuring an excellent operation of the actuator.

Particularly, when the throttle-provided line is provided, although the flow rate is reduced by the throttle, a slight amount of the hydraulic oil always flows in the throttle-provided line and the hydraulic oil is returned to the hydraulic oil tank. Herein, since the throttle-provided line is provided to the discharge-side line of the pilot pump, sufficient flow rate of the hydraulic oil necessary on the main pump side that needs comparatively large flow rate of the hydraulic oil for driving the actuator can be ensured, thereby easily ensuring sufficient pressure of the hydraulic oil.

In the hydraulic excavator according to the aspect of the invention, the hydraulic pump may include a main pump that supplies the hydraulic oil to the actuator and a pilot pump that supplies the hydraulic oil for operating the control valve. The throttle-provided line or the switching-valve-provided line may be provided so as to communicate the discharge-side line of the main pump and the hydraulic oil tank.

According to the aspect of the invention, since the throttle-provided line or the switching-valve-provided line is provided so as to communicate the discharge-side line of the main pump and the hydraulic oil tank, the air in the hydraulic oil passes through the main pump with smaller flow passage resistance to be discharged through the discharge-side line of the main pump and the throttle-provided line or the switching-valve-provided line. Herein, since that the flow rate of the main pump is generally larger than that of the pilot pump, the air is speedily removed. Hence, the work time for removing the air can be reduced and the hydraulic pressure can be speedily obtained, thereby ensuring an excellent initial responsiveness of the actuator.

EXPLANATION OF CODES

Figure 1:
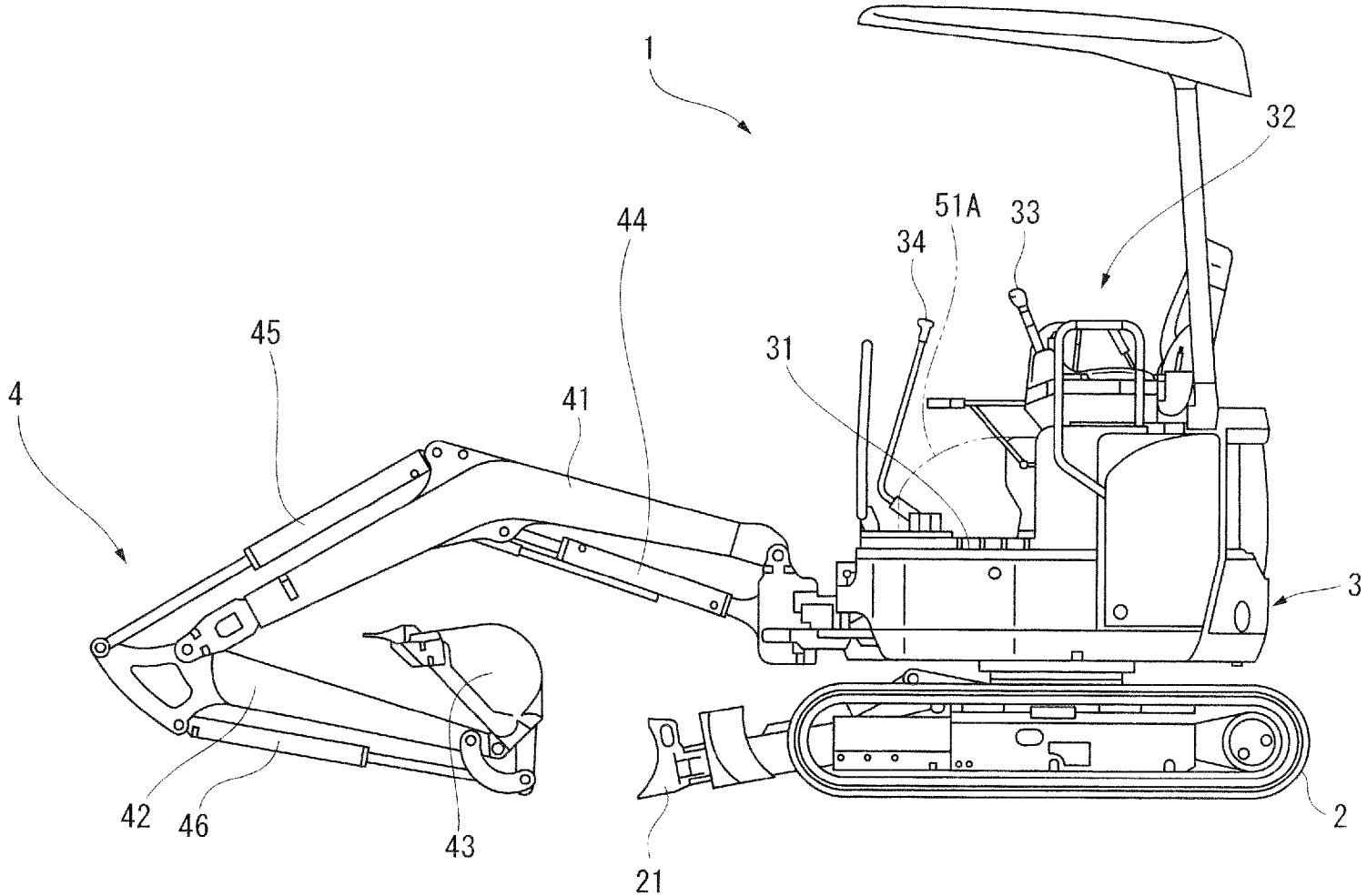
FIG. 1 shows an overall view of a hydraulic excavator according to a first embodiment of the invention.

1: hydraulic excavator
5: hydraulic circuit
7: throttle-provided line
8: switching-valve-provided line
44, 45, 46: hydraulic cylinder (actuator)
51: hydraulic oil tank
52: hydraulic pump
54: control valve
71, 81: line
72: throttle
82: switching valve
91, 93: line (discharge-side line)
521: main pump
522: pilot pump

BEST MODE FOR CARRYING OUT THE INVENTION

Embodiments of the present invention will be described below with reference to the drawing.

In below-described second to fourth embodiments, the same components or components having a similar function to those of a first embodiment will be given the same reference numerals as in the first embodiment to simplify or omit the description.

First Embodiment

FIG. 1 shows an overall view of a hydraulic excavator 1 according to the first embodiment of the invention. In FIG. 1, the hydraulic excavator 1 includes a carrier 2, a rotary body 3 rotatably disposed above the carrier 2 and a working equipment 4 attached on a front side of the rotary body 3.

In the first embodiment, the carrier 2 is a crawler-type that includes a crawler belt, but the arrangement is not limited thereto. Alternatively, the carrier 2 may be a wheel-type with tires and the like. A dozer 21 is provided on a front side of the carrier 2.

An operator seat 32 is provided on the rotary body 3 for operating a movement of the working equipment 4, a rotary movement of the rotary body 3 and right and left traveling movements of the carrier 2 using a working-equipment lever 33, a driving lever 34 or the like. A hydraulic circuit 5 (see FIG. 2) that controls the movement of the working equipment 4, the rotary body 3 and the carrier 2 is accommodated below the operator seat 32 of the rotary body 3.

The working equipment 4 includes a boom 41, an arm 42, a bucket 43 and hydraulic cylinders (actuators) 44, 45 and 46 for respectively driving the boom 41, the arm 42 and the bucket 43. The rotary movement of the rotary body 3 and the traveling movement of the carrier 2 are effected by a not-shown hydraulic motor (an actuator) that is hydraulically driven.

Figure 2:
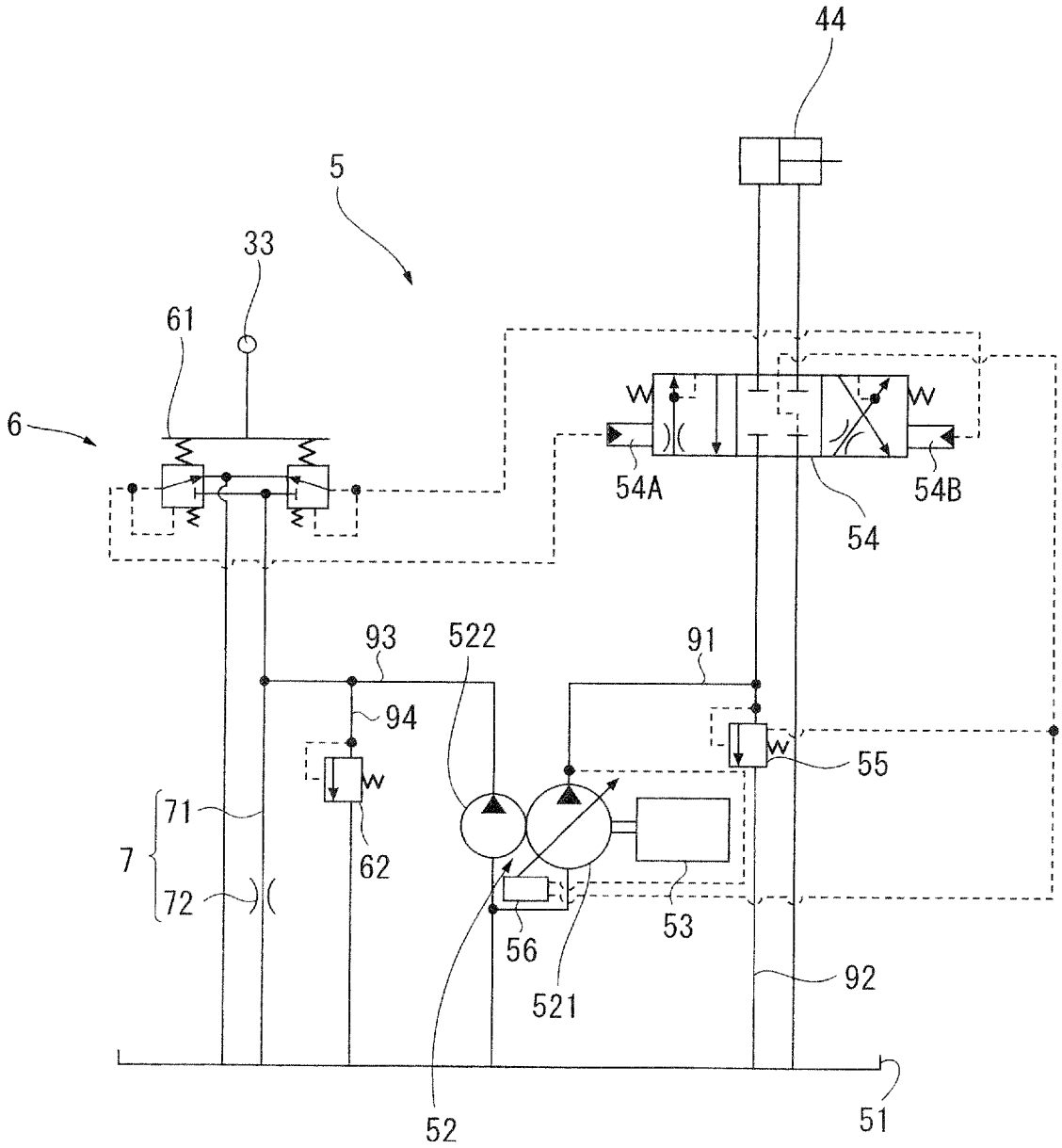
FIG. 2 is a schematic diagram showing a hydraulic circuit of the hydraulic excavator according to the first embodiment of the invention.

FIG. 2 is a schematic diagram showing the hydraulic circuit 5 of the hydraulic excavator 1 according to the first embodiment. The hydraulic circuit 5 includes a hydraulic oil tank 51 in which hydraulic oil is stored, a hydraulic pump 52 for delivering the hydraulic oil from the hydraulic oil tank 51, an engine 53 for driving the hydraulic pump 52, a control valve 54 for switching a feed of the operation oil from the hydraulic pump 52, the hydraulic cylinder 44 operated by hydraulic pressure of the hydraulic oil and a pilot circuit 6 for hydraulically switching the control valve 54.

Note that, in an actual hydraulic circuit, the hydraulic cylinders 44, 45 and 46, a hydraulic motor for a rotary movement of the rotary body 3 and a hydraulic motor for a traveling movement of the carrier 2 are respectively connected to different control valves that are connected in parallel to the common hydraulic pump 52. However, to simplify the description only one of these components (the hydraulic cylinder 44) is shown in FIG. 2, which will be described below.

The hydraulic pump 52 includes a main pump 521 for feeding the hydraulic oil to the control valve 54 and a pilot pump 522 of the pilot circuit 6.

Herein, the main pump 521 is a swash-plate variable-capacity piston pump. However, instead of the swash-plate variable-capacity piston pump, any pump such as a clinoaxis variable-capacity pump and the like may be used as the main pump 521. The main pump 521 is provided with a pump-capacity controller 56 that controls a flow rate of the pump. The pump-capacity controller 56 monitors a differential pressure of a discharge pressure of the main pump 521 and a load pressure of the hydraulic cylinder 44 and controls a flow rate of the main pump 521 to maintain the differential pressure constant.

A bypass line 92 in communication with the hydraulic oil tank 51 is provided in a line (a discharge side line) 91 between a discharge port of the main pump 521 and the control valve 54. The bypass line 92 is provided with an unload valve 55. The unload valve 55 opens a flow passage when the differential pressure of the discharge pressure of the main pump 521 and the load pressure of the hydraulic cylinder 44 exceeds a predetermined value to return the hydraulic oil to the hydraulic oil tank 51.

The pilot pump 522 is a fixed-capacity gear pump and is integrated with the main pump 521.

The control valve 54 is a closed-center switching valve, by which a feed of the hydraulic oil to the hydraulic cylinder 44 is shut during a neutral operation.

The pilot circuit 6 includes the above-mentioned pilot pump 522, switching sections 54A, 54B of the control valve 54 to which pressure oil from the pilot pump 522 is supplied and a PPC (Proportional Pressure Control) valve 61 that switches the feed of the pressure oil and is disposed between the pilot pump 522 and the switching sections 54A. 54B.

The PPC valve 61 switches the feed of the pressure oil to the switching section 54A or the switching section 54B in accordance with an operation on the working-equipment lever 33 by an operator. The switching by the PPC valve 61 switches the control valve 54 using hydraulic pressure.

A bypass line 94 in communication with the hydraulic oil tank 51 is provided at an intermediate position on a line (a discharge-side line) 93 between the pilot pump 522 and the PPC valve 61. The bypass line 94 is provided with a relief valve 62. The relief valve opens when a discharge pressure of the pilot pump 522 exceeds a predetermined value (a relief pressure) to return the hydraulic oil from the pilot pump 522 to the hydraulic oil tank 51 via the bypass line 94.

A line 71 communicating the line 93 and the hydraulic oil tank 51 is provided to the line 93 at a position near the PPC valve 61 that is disposed on the downstream of the relief valve 62 (i.e. at a position between the relief valve 62 and the PPC valve 61). A throttle 72 is provided at an intermediate position on the line 71. The line 71 and the throttle 72 constitute a throttle-provided line 7 of the invention.

Figure 3:
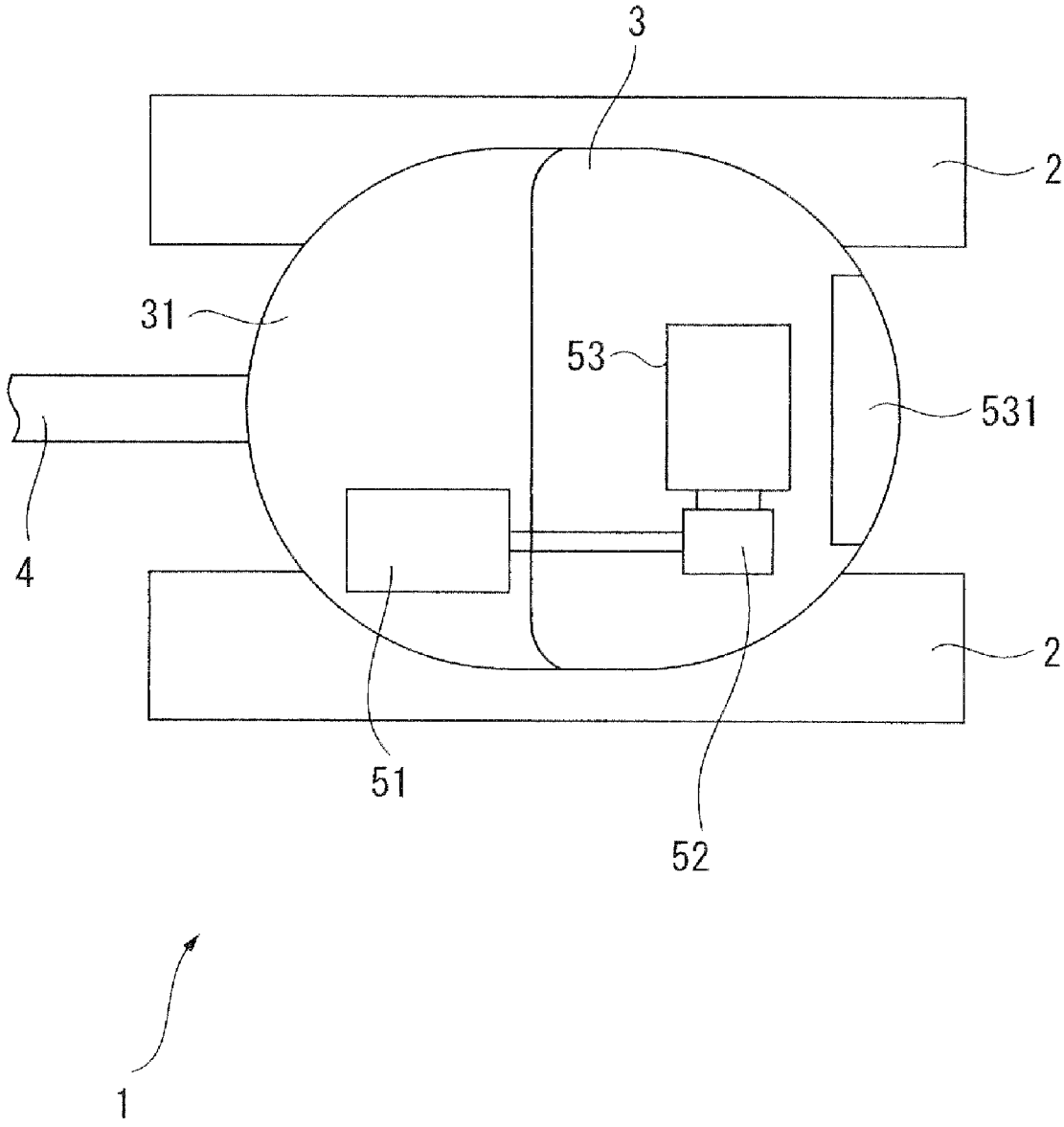
FIG. 3 shows a plan view of the hydraulic excavator according to the first embodiment of the invention.
Figure 4:
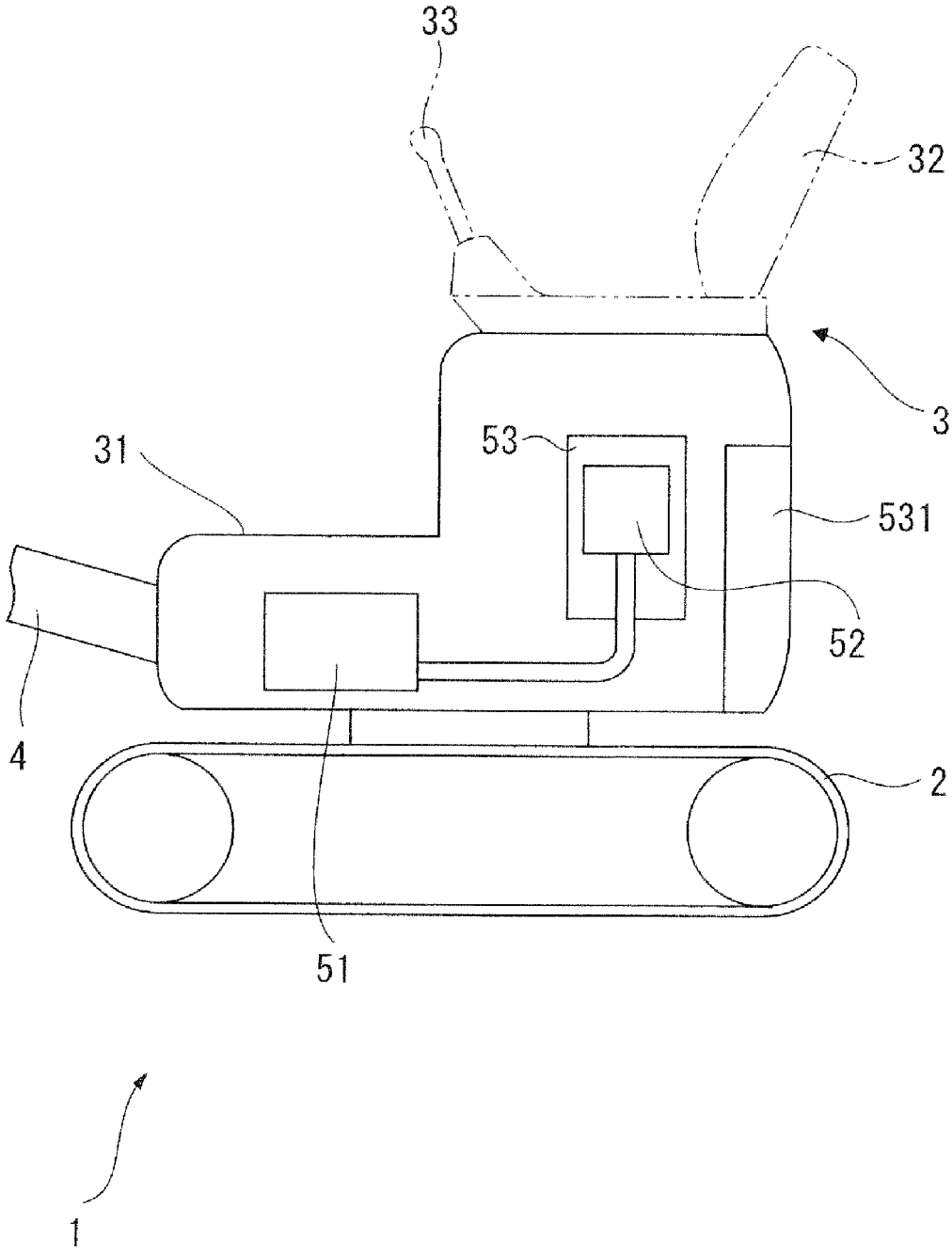
FIG. 4 shows a side elevation of the hydraulic excavator according to the first embodiment of the invention.

FIG. 3 shows a plan view of the hydraulic excavator 1 of the first embodiment. FIG. 4 shows a side elevation of the hydraulic excavator 1 of the first embodiment. FIGS. 3 and 4 are transparent views schematically showing an arrangement of primary components such as the hydraulic circuit 5.

In FIGS. 3 and 4, a fuel tank 531 for supplying fuel to the engine 53 is disposed at a rear-most end of the rotary body 3. The engine 53 is disposed on a front side of the fuel tank 531 and below the operator seat 32. The hydraulic pump 52 is disposed in the vicinity of the engine 53 and below the engine 53. The hydraulic oil tank 51 is disposed on a front side of the hydraulic pump 52 and the operator seat 32 and below a floor 31. As shown in FIG. 4, since the hydraulic oil tank 51 is disposed below the floor 31, the hydraulic oil tank 51 is located at a vertically lower position of the hydraulic pump 52.

The hydraulic excavator 1 is operated as described below.

To raise the boom 41, the working-equipment lever 33 is operated to switch the PPC valve 61 to hydraulically switch the control valve 54 to a raising position (on a left side of the control valve 54 in FIG. 2). When the control valve 54 is at the raising position, the hydraulic oil from the main pump 521 is supplied to the hydraulic cylinder 44 and the hydraulic pressure of the hydraulic oil moves a piston of the hydraulic cylinder 44. Accordingly, the boom 41 is raised.

On the other hand, to lower the boom 41, the control valve 54 is switched to a lowering position (to a right side of the control valve 54 in FIG. 2). When the control valve 54 is at the lowering position, the hydraulic oil from the main pump 521 is supplied in the opposite direction of the raising position inside the hydraulic cylinder 44, thereby moving the piston of the hydraulic cylinder 44 to the opposite side of the raising position. Thus, the boom 41 is lowered.

When the control valve 54 is at a neutral position (at the center of the control valve 54 in FIG. 2), since the supply of the hydraulic pressure to the hydraulic cylinder 44 is shut, the hydraulic pressure of the hydraulic cylinder 44 is maintained constant and the boom 41 is maintained at the current position. During the process, when the load becomes large, the hydraulic oil is returned to the hydraulic oil tank 51 from the unload valve 55.

During a long term usage of the hydraulic circuit 5, the reduced hydraulic oil in the hydraulic oil tank 51 needs to be supplemented or the hydraulic oil in the hydraulic oil tank 51 needs to be changed for maintenance. Since the hydraulic oil tank 51 is disposed at a lower position of the hydraulic pump 52, the level of the hydraulic oil in the hydraulic oil tank 51 is located below the hydraulic pump 52 on account of hydraulic oil reduction or when the hydraulic oil tank 51 is refilled with new hydraulic oil after removing the old hydraulic oil from the hydraulic oil tank 51, the hydraulic oil between the hydraulic oil tank 51 and the hydraulic pump 52 may flow off to be replaced by trapped air.

In this case, when the hydraulic pump 52 is operated, the trapped air gradually moves into the hydraulic pump 52. Since the throttle-provided line 7 is provided on the side of the pilot pump 522, the cooling device 71 is open to the hydraulic oil tank 51. On the other hand, the line 91 from the main pump 521 to the control valve 54 is filled with the hydraulic oil, resistance in the lines 93, 71 on the pilot pump 522 side is smaller than that in the line 91 on the side of the main pump 521. Hence, the air enters the throttle-provided line 7 via the pilot pump 522 and discharged through the lines 71, 72 to the hydraulic oil tank 51. Thus, since the air can be removed only by providing the throttle-provided line 7, the structure and control of the hydraulic circuit 5 can be simplified. In addition, since the air is removed by the throttle-provided line 7 before the hydraulic oil circulates the pilot circuit 6, aeration or cavitation caused by air trapping can be avoided, thereby preventing a malfunction of the hydraulic circuit 5.

Even when air is trapped between the hydraulic oil tank 51 and the hydraulic pump 52, the trapped air can be appropriately removed by providing the throttle-provided line 7, so that an initial responsiveness of the working equipment 4 is not impaired even when the hydraulic oil tank 51 is disposed at a lower position of the hydraulic pump 52. In a conventional hydraulic excavator 1, the hydraulic oil tank 51 needs to be located at an upper position of the hydraulic pump 52 to prevent the air from entering, which requires a projecting portion 51A to dispose a conventional hydraulic oil tank next to the operator seat 32 as shown in a chain double-dashed line in FIG. 1. The projecting portion 51 makes the operator seat 32 narrow and hinders the operator seat 32 from being disposed at the center of the rotary body 3. In contrast, in the hydraulic excavator 1 of the first embodiment, since the hydraulic oil tank 51 can be provided below the floor 31, the operator seat 32 can be made large to improve its comfortability. In addition, since the operator can ride on and off the rotary body 3 from both sides, the usability can be enhanced.

After the trapped air is removed through the throttle-provided line 7, the hydraulic oil enters the throttle-provided line 7. Since the flow rate is reduced by the throttle 72 of the throttle-provided line 7, the resistance restricts the flow of the hydraulic oil, which makes the hydraulic oil to be supplied to the PPC valve 61 via the line 93 from the pilot pump 522. Simultaneously, the hydraulic oil is supplied to the control valve 54 via the line 91 from the main pump 521. Accordingly, sufficient hydraulic pressure necessary for the hydraulic cylinder 44 can be generated thus allowing the operation of the hydraulic cylinder 44.

Since the hydraulic oil is supplied to the PPC valve 61 and the control valve 54 after the air in the hydraulic oil is removed by the throttle 72, sufficient hydraulic pressure necessary for operating the hydraulic cylinder 44 can be quickly obtained, so that the hydraulic cylinder 44 and the switching sections 54A, 54B can be speedily operated to enhance the responsiveness of the hydraulic excavator 1. Since the throttle 72 is provided, the resistance is increased in the air-removed hydraulic oil, so that the hydraulic oil can be automatically supplied to the PPC valve 61 and the control valve 54, which eliminates a structure or control for shutting the throttle-provided line 7. Hence, the structure and control of the hydraulic circuit 5 can be simplified.

Note that, when the hydraulic circuit 5 is in operation, a slight amount of hydraulic oil always flows in the throttle-provided line 7 and a portion of the hydraulic oil from the pilot pump 522 is returned to the hydraulic oil tank 51. However, in the first embodiment, since the throttle-provided line 7 is provided in the pilot circuit 6, the sufficient flow rate of the hydraulic oil can be ensured on the main pump 521 side on which a large flow rate is required as compared with the pilot circuit 6. Therefore, the maximum flow rate of the pilot pump 522 can be reliably obtained, so that the hydraulic pressure necessary or the hydraulic cylinder 44 can be easily obtained.

Second Embodiment

Next, the second embodiment of the invention will be described. The second embodiment has the same arrangement as the first embodiment except that the throttle-provided line 7 is attached in a different manner from that of the first embodiment.

Figure 5:
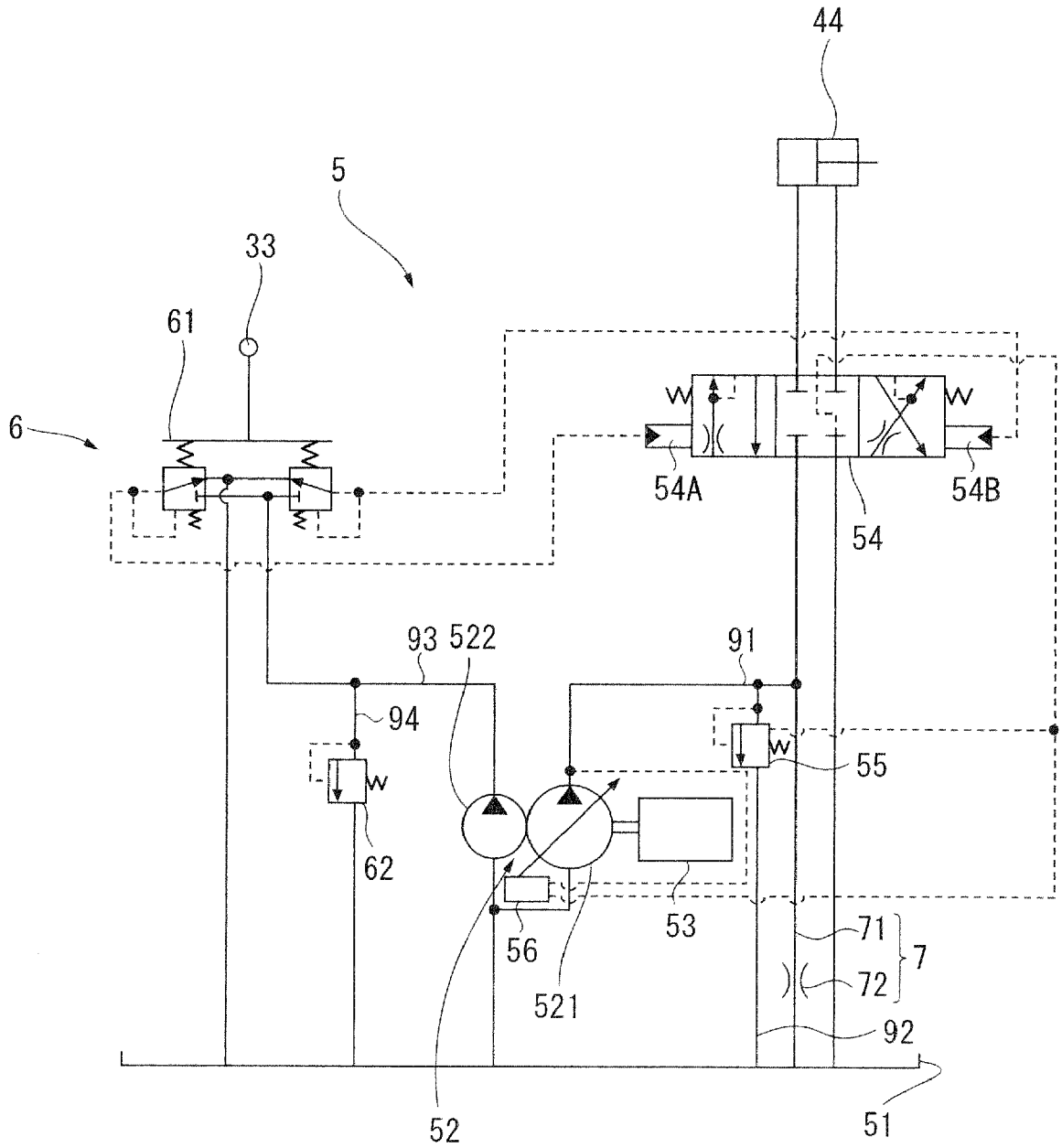
FIG. 5 is a schematic diagram showing a hydraulic circuit of a hydraulic excavator according to a second embodiment of the invention.

FIG. 5 is a schematic diagram showing the hydraulic circuit 5 of the hydraulic excavator 1 according to the second embodiment of the invention. In FIG. 5, the throttle-provided line 7 is provided to the line 91 at a position near the control valve 54 that is disposed on the downstream of the unload valve 55 (i.e. at a position between the unload valve 55 and the control valve 54).

In the second embodiment, when air is trapped between the hydraulic oil tank 51 and the hydraulic pump 52, actuation of the hydraulic pump 52 moves the air from the main pump 521 through the throttle-provided line 7 into the hydraulic oil tank 51. Since the throttle-provided line 7 is provided on the side of the main pump 521 on which the flow rate is larger than the side of the pilot pump 522, the trapped air can be speedily discharged, thereby enhancing activation capability of the hydraulic excavator 1.

When the hydraulic oil is flown in the throttle-provided line 7 after the air is discharged, resistance in the throttle 72 is increased, which automatically supplies the hydraulic oil to the control valve 54 from the main pump 521. Simultaneously, the hydraulic oil is also supplied to the PPC valve 61 from the pilot pump 522. Accordingly, sufficient hydraulic pressure necessary for operating the hydraulic cylinder 44 and the switching sections 54A, 54B can be generated, so that the hydraulic cylinder 44 can be activated.

Third Embodiment

Next, the third embodiment of the invention will be described. The third embodiment has the same arrangement as the first embodiment except that the throttle-provided line 7 of the first embodiment is replaced by a switching-valve-provided line 8.

Figure 6:
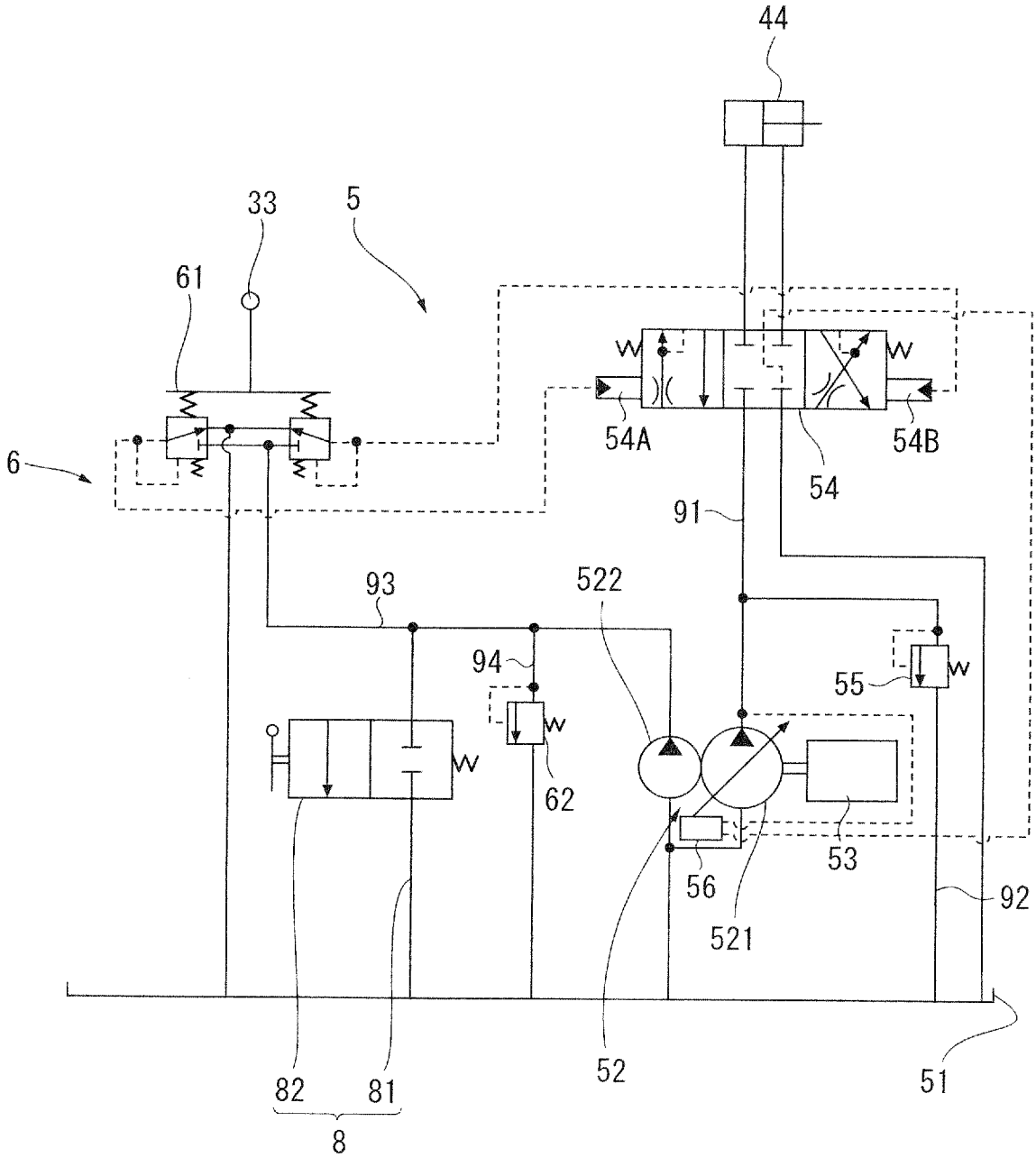
FIG. 6 is a schematic diagram showing a hydraulic circuit of a hydraulic excavator according to a third embodiment of the invention.

FIG. 6 is a schematic diagram showing the hydraulic circuit 5 of the hydraulic excavator 1 according to the third embodiment of the invention. In FIG. 6, a line 81 communicating the line 93 and the hydraulic oil tank 51 and a switching valve 82 that is provided at an intermediate position on the line 81 for opening and closing the flow passage of the line 81 are provided to the line 93 at positions near the PPC valve 61 that is disposed on the downstream of the relief valve 62 (i.e. at positions between the relief valve 62 and the PPC valve 61). The switching valve 82 can be manually switched by an operator on the operator seat 32. The line 81 and the switching valve 82 constitute the switching-valve-provided line 8 of the invention.

In the third embodiment, when air is trapped between the hydraulic oil tank 51 and the hydraulic pump 52, the switching valve 82 is manually switched to an open position. When the hydraulic pump 52 is operated with the switching valve 82 at the open position, the air is discharged from the pilot pump 522 through the switching-valve-provided line 8 into the hydraulic oil tank 51. When the air in the hydraulic circuit 5 is discharged, the hydraulic oil is discharged from the line 81 and then the operator manually switches the switching valve 82. Accordingly, the line 81 is closed, so that the hydraulic oil is supplied from the pilot pump 522 to the PPC valve 61 and also from the main pump 521 to the control valve 54. Hence, sufficient hydraulic pressure necessary for operating the hydraulic cylinder 44 can be obtained, so that the hydraulic cylinder 44 becomes operatable.

Since the switching section 8 is provided, it is possible to open and close the line 81. Accordingly, after the air in the hydraulic oil is removed, the hydraulic oil can be supplied from the pilot pump 522 to the PPC valve 61 and from the main pump 521 to the control valve 54 by closing the switching valve 82. Unlike the first embodiment, by switching the switching valve 82 to the close position, the entire hydraulic oil delivered by the hydraulic pump 52 is supplied to the PPC valve 61 and the control valve 54. Thus, the hydraulic oil can be entirely used without any waste for generating hydraulic pressure. Hence, sufficient hydraulic pressure necessary for operating the hydraulic cylinder 44 and the switching sections 54A, 54B can be easily and speedily obtained.

Fourth Embodiment

Next, the fourth embodiment of the invention will be described. The fourth embodiment has the same arrangement as the third embodiment except for a point that the switching-valve-provided line 8 is attached at a different position from that of the third embodiment.

Figure 7:
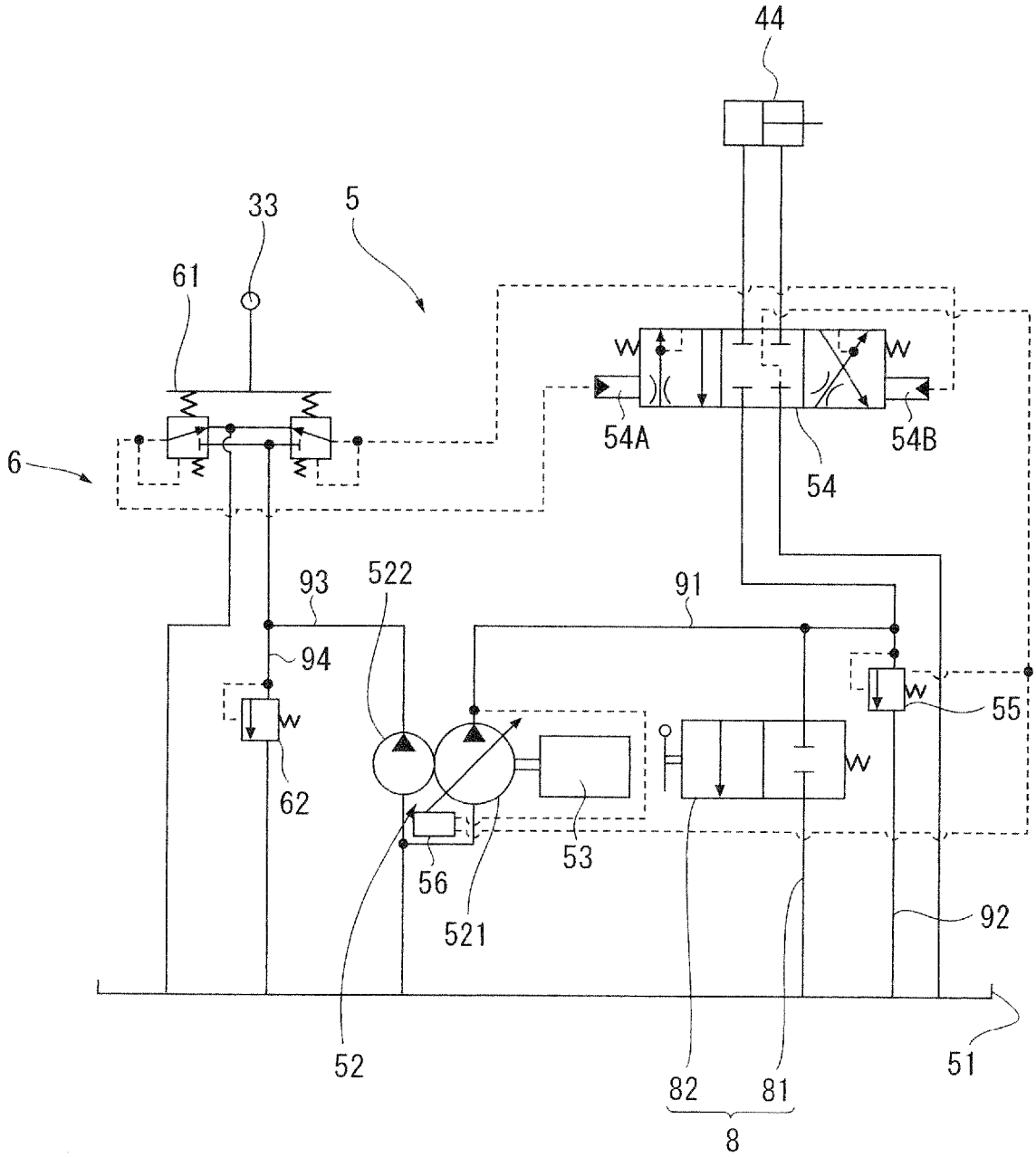
FIG. 7 is a schematic diagram showing a hydraulic circuit of a hydraulic excavator according to a fourth embodiment of the invention.

FIG. 7 is a schematic diagram showing the hydraulic circuit 5 of the hydraulic excavator 1 according to the fourth embodiment. In FIG. 7, the switching-valve-provided line 8 communicating the line 91 and the hydraulic oil tank 51 is provided to the line 91 at a position near the control valve 54 that is disposed on the downstream of the unload valve 55 (i.e. at a position between the unload valve 55 and the control valve 54).

In the fourth embodiment, when air is trapped between the hydraulic oil tank 51 and the hydraulic pump 52, the switching valve 82 is switched to an open position and the hydraulic pump 52 is operated. Accordingly, the air is discharged from the main pump 521 through the switching-valve-provided line 8 into the hydraulic oil tank 51. After the discharge of the air is completed, by switching the switching valve 82 to the close position to deliver the hydraulic oil by the hydraulic pump 52, the hydraulic oil is supplied from the main pump 521 to the control valve 54 and from the pilot pump 522 to the PPC valve 61.

Note that the scope of the present invention is not limited to the above-described embodiments, but modifications or improvements are also included in the scope of the invention as long as an object of the invention can be achieved.

The control valve is not limited to a valve that is hydraulically switched in a pilot circuit but may be, for instance, a valve that is provided with no pilot valve and is manually or electrically switched. When no pilot circuit is provided, the throttle-provided line or the switching-valve-provided line may be provided on the discharge-side line of the hydraulic pump (the main pump) for communicating the discharge side line and the hydraulic oil tank.

Any type of control valve may be selected in accordance with a usage purpose or specifications of the hydraulic circuit as long as the switching valve is a closed-center type.

The switching valve provided to the switching-valve-provided line is not limited to a manually-switched valve, but may be a valve that is hydraulically or electrically switched.

The hydraulic oil tank may not be necessarily disposed below the hydraulic pump, but the position of the hydraulic oil tank can be flexibly set in accordance with the size, specifications and the like of the hydraulic excavator.

Although the best mode, process and the like for implementing an aspect of the invention have been disclosed above, the scope of the invention is not limited thereto. Specifically, although the invention is mainly illustrated and described in relation with particular embodiments, a skilled person in the art can make a modification in terms of a shape, material and other details of the above-described embodiments without departing from the technical idea and the scope of the invention.

Accordingly, the above-disclosed description including a limitation on a shape, material and others is given as an example only for facilitating the understanding of the invention but not with an intention for limiting the scope of the invention. Therefore, description using a component name without a part of or all of the limitation on a shape, material and others is also included in the scope of the invention.

INDUSTRIAL APPLICABILITY

The present invention is applicable to various hydraulic excavators with an attachment such as a hoe, a shovel and a crane and especially to a small-size hydraulic excavator in which space efficiency is important.

The invention claimed is:

1. A hydraulic excavator, comprising:

a hydraulic oil tank that stores hydraulic oil;

a hydraulic pump that delivers the hydraulic oil from the hydraulic oil tank;

an actuator that is driven by hydraulic pressure;

a closed-center control valve that is provided between the hydraulic pump and the actuator and switches a supply of the hydraulic oil;

a line that communicates with a discharge-side line of the hydraulic pump and the hydraulic oil tank; and a throttle arranged in the line between the discharge-side line of the hydraulic pump and the hydraulic oil tank.

2. The hydraulic excavator according to claim 1, wherein:

the hydraulic pump includes a main pump that supplies the hydraulic oil to the actuator and a pilot pump that supplies the hydraulic oil for operating the control valve, and the line in which the throttle is arranged is provided so as to communicate with the discharge-side line of the main pump and the hydraulic oil tank.

3. The hydraulic excavator according to claim 1, wherein:

the hydraulic pump includes a main pump that supplies the hydraulic oil to the actuator and a pilot pump that supplies the hydraulic oil for operating the control valve, and the line in which the throttle is arranged is provided so as to communicate with the discharge-side line of the pilot pump and the hydraulic oil tank.

4. A hydraulic excavator, comprising:

a hydraulic oil tank that stores hydraulic oil;

a hydraulic pump that delivers the hydraulic oil from the hydraulic oil tank;

an actuator that is driven by hydraulic pressure;

a closed-center control valve that is provided between the hydraulic pump and the actuator and switches a supply of the hydraulic oil;

a line that communicates with a discharge-side line of the hydraulic pump and the hydraulic oil tank; and a switching valve arranged in the line between the discharge-side line of the hydraulic pump and the hydraulic oil tank and that opens and closes a flow passage defined in the line.

5. The hydraulic excavator according to claim 4, wherein:

the hydraulic pump includes a main pump that supplies the hydraulic oil to the actuator and a pilot pump that supplies the hydraulic oil for operating the control valve, and the line in which the switching valve is arranged is provided so as to communicate with the discharge-side line of the pilot pump and the hydraulic oil tank.

6. The hydraulic excavator according to claim 4, wherein:

the hydraulic pump includes a main pump that supplies the hydraulic oil to the actuator and a pilot pump that supplies the hydraulic oil for operating the control valve, and the line in which the switching valve is arranged is provided so as to communicate with the discharge-side line of the main pump and the hydraulic oil tank.

* * * * *